United States Patent [19]

Bauer

[11] 4,286,243

[45] Aug. 25, 1981

[54] ELECTRICAL SWITCH CONSTRUCTIONS AND METHODS OF MAKING THE SAME

[75] Inventor: Werner R. Bauer, Radnor, Pa.

[73] Assignee: Robertshaw Controls Company, Richmond, Va.

[21] Appl. No.: 80,573

[22] Filed: Oct. 1, 1979

[51] Int. Cl.[3] ..... H01F 7/12; H01H 3/60

[52] U.S. Cl. ..... 335/193; 335/247; 335/258

[58] Field of Search ..... 335/192–194, 335/46, 271, 104, 247, 248, 156, 157, 158, 249, 257

[56] References Cited

U.S. PATENT DOCUMENTS

| | | | |
|---|---|---|---|
| 3,665,353 | 5/1972 | Campbell | 335/258 |
| 4,063,204 | 12/1977 | McFarlin | 335/104 X |
| 4,095,200 | 6/1978 | Gallatin | 335/193 |
| 4,114,125 | 9/1978 | Komatsu | 335/258 |
| 4,177,440 | 12/1979 | Merlette | 335/258 X |

*Primary Examiner*—Robert J. Hickey
*Attorney, Agent, or Firm*—Candor, Candor & Tassone

[57] ABSTRACT

A switch construction having a support carrying switch contacts and an electrical coil that has an armature operatively associated with the switch contacts to cause a switching operation therewith when the coil is energized to attract the armature from a first position thereof to a second position thereof relative to the coil. A mechanical spring arrangement is operatively associated with the armature to continuously resist the movement thereof from the first position thereof to the second position thereof with an increasing force that overcomes the increasing pull in force of the energized coil on the armature before the armature reaches its zero gap with the energized coil whereby the spring arrangement prevents the armature from reaching its zero gap and thereby causes the switch construction to be relatively noiseless in the operation thereof.

50 Claims, 11 Drawing Figures

ELECTRICAL SWITCH CONSTRUCTIONS AND METHODS OF MAKING THE SAME

BACKGROUND OF THE INVENTION

1. Field of the Invention

This invention relates to improved electrical switch constructions of the coil-armature actuator type and to methods of making such switch constructions or the like.

2. Prior Art Statement

It is known to provide a switch construction having a support means carrying switch contact means and electrical coil means that has an armature means operatively associated with the switch contact means to cause a switching operation therewith when the coil means is energized to attract the armature means from a first position thereof to a second position thereof relative to the coil means.

It is also known to tend to prevent the armature means of such a switch construction from making a noise when the armature means is fully pulled in by the energized coil means. One such prior known means is to provide a rubber pad inside the coil means so that the armature means will engage the pad when the armature means is fully pulled into the energized coil means. Another such prior known means comprises a dash pot arrangement with the coil means and armature means so that as the armature means is pulled into the energized coil means, an air cushion forms between the armature means and an apertured end wall of the coil means which provides a dash pot effect as the armature means moves further into the energized coil means.

SUMMARY OF THE INVENTION

It is a feature of this invention to provide a switch construction of the coil-armature actuator type with a unique means to render the same substantially noiseless in the operation thereof.

In particular, it was found according to the teachings of this invention, that if the armature means of the above type of switch construction can be stopped in its movement before the same reaches its pulling in zero gap position with the energized coil means therefor, the operation of such a switch construction would be relatively noiseless.

However, it would also be found according to the teachings of this invention, that the movement of the armature means cannot be stopped by a rubber stop or the like as utilized in the past because a noise still is created when the armature means engages such a rubber stop.

Accordingly, it was found according to the teachings of this invention, that a unique mechanical spring arrangement can be provided for such a switch construction to render the same relatively noiseless in the operation thereof.

In particular, one embodiment of this invention provides a switch construction having support means carrying switch contact means and an electrical coil means that has an armature means operatively associated with the switch contact means to cause a switching operation therewith when the coil means is energized to attract the armature means from a first position thereof to a second position relative to the coil means. Mechanical spring means is operatively associated with the armature means to continuously resist the movement thereof from the first position thereof to the second position thereof with an increasing force that overcomes the increasing pull in force of the energized coil means on the armature means before the armature means reaches its zero gap with the energized coil means whereby the spring means prevents the armature means from reaching its zero gap and thereby causes the switch construction to be relatively noiseless in the operation thereof.

Accordingly, it is an object of this invention to provide an improved switch construction having one or more of the novel features of this invention as set forth above or hereinafter shown or described.

Another object of this invention is to provide a method of making such a switch construction or the like, the method of this invention having one or more of the novel features of this invention as set forth above or hereinafter shown or described.

Other objects, uses, and advantages of this invention are apparent from a reading of this description which proceeds with reference to the accompanying drawings forming a part thereof and wherein:

DESCRIPTION OF THE PREFERRED EMBODIMENTS

Figure 1:
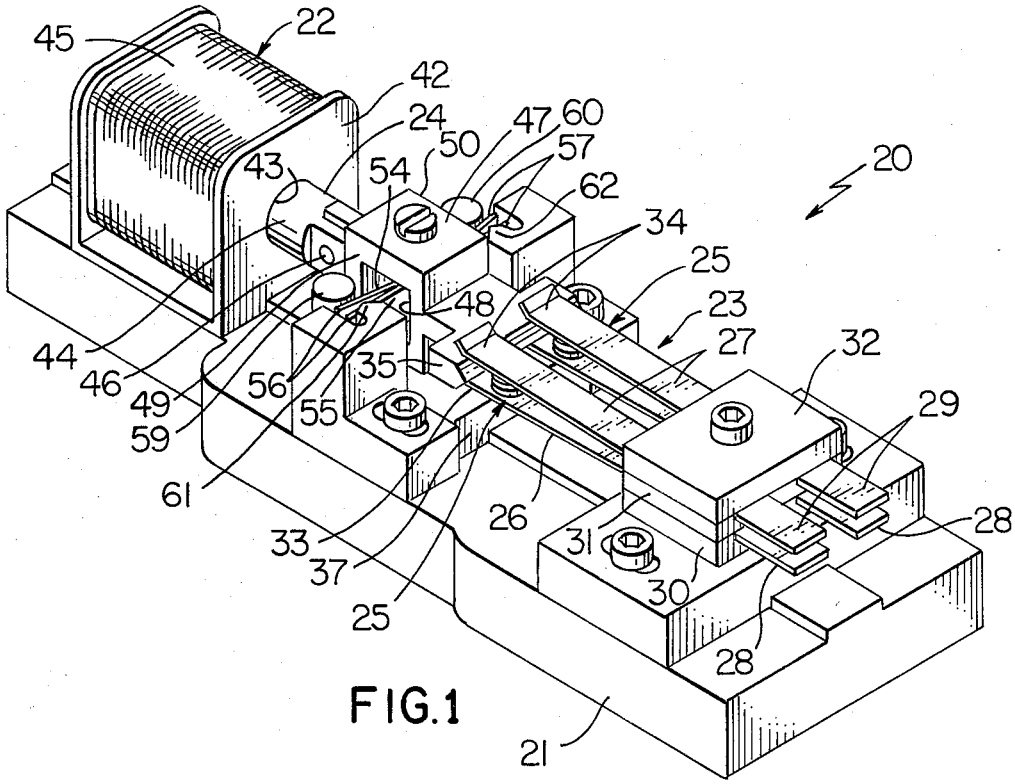
FIG. 1 is a top perspective view of an improved switch construction of this invention.
Figure 2:
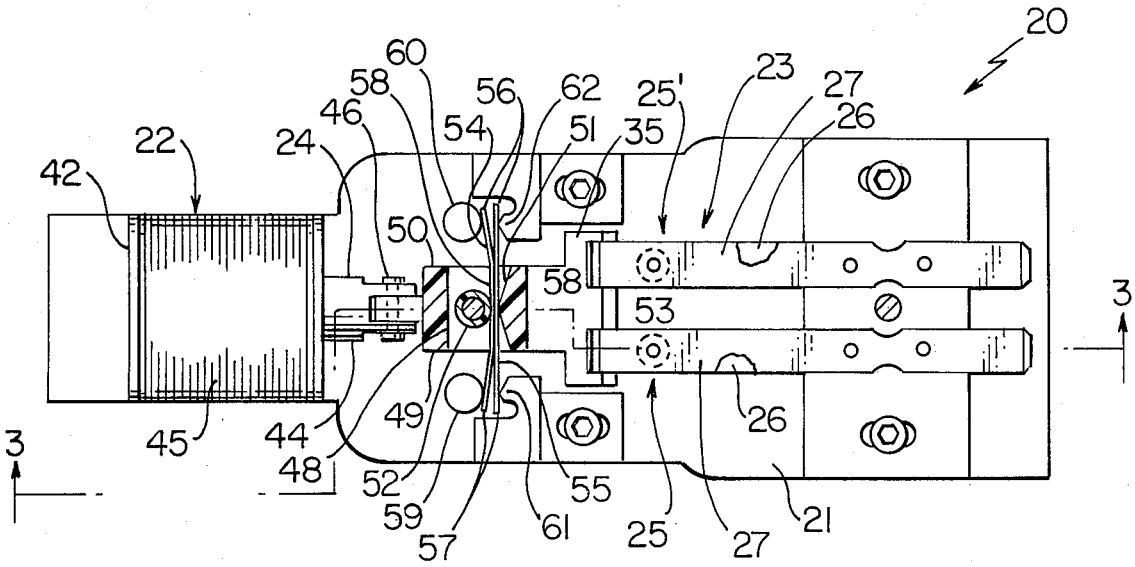
FIG. 2 is a top view of the switch construction illustrated in FIG. 2 with certain parts thereof removed or shown in cross section.
Figure 4:
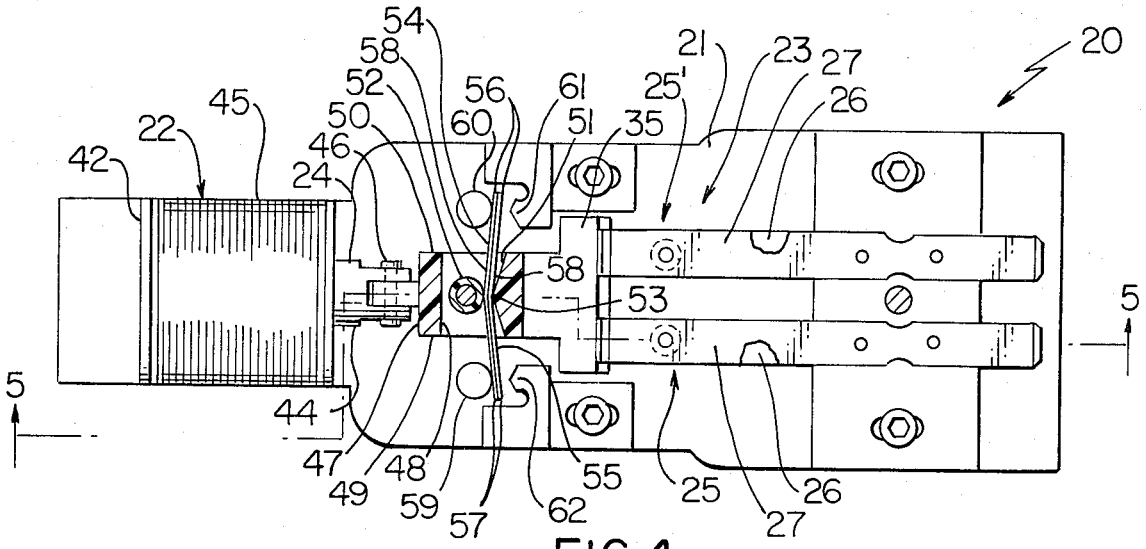
FIG. 4 is a view similar to FIG. 2 and illustrates the switch construction in another operating position thereof.
Figure 3:
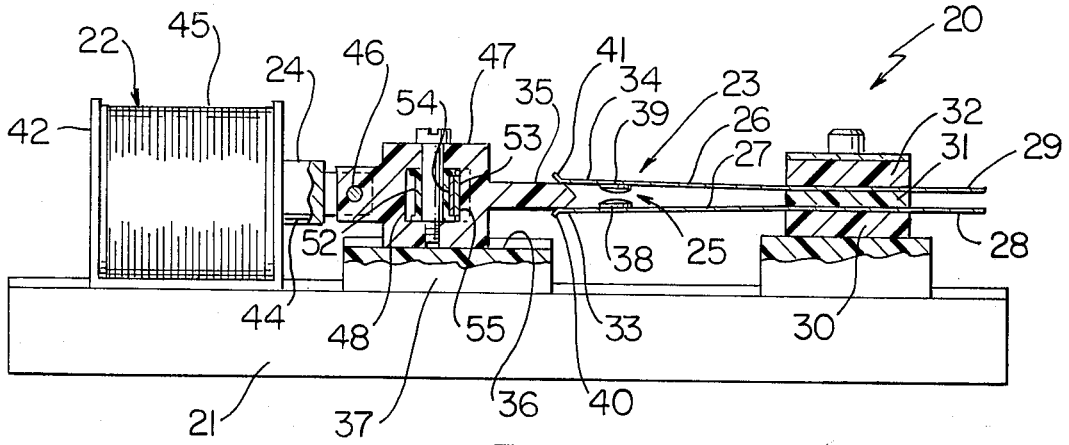
FIG. 3 is a cross-sectional view taken on line 3—3 of FIG. 2.
Figure 5:
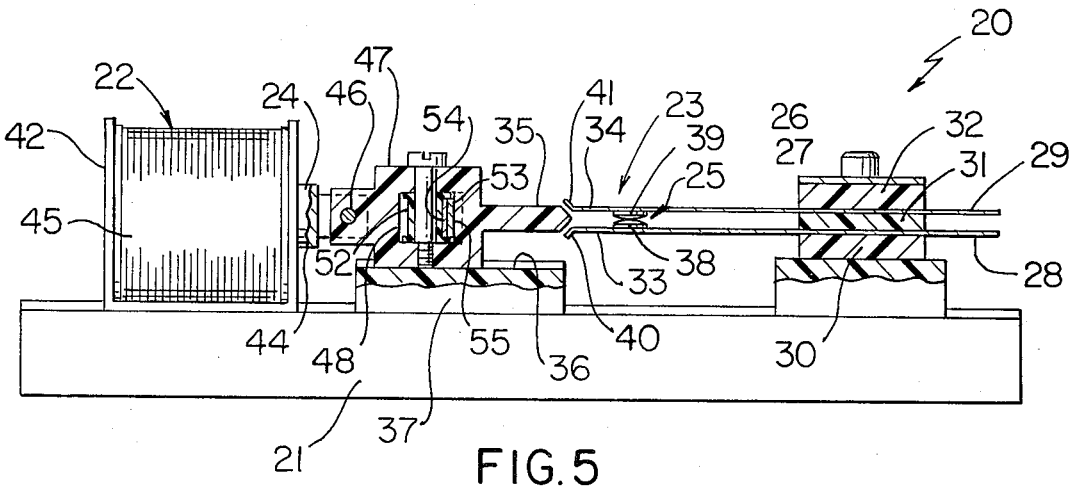
FIG. 5 is a cross-sectional view taken on line 5—5 of FIG. 4.

Referring now to FIGS. 1–5, an improved electrical switch construction of this invention is generally indicated by the reference numeral 20 and comprises a support means 21 carrying an electrical coil means 22 and switch contact means that are generally indicated by the reference numeral 23 to be operated by an armature means 24 that is normally disposed in the position illustrated in FIGS. 2 and 3 when the coil means 22 is in a non-energized condition thereof and is moved to the position illustrated in FIGS. 4 and 5 when the coil means 22 is energized by a D.C. electrical current source (not shown).

The contact means 23 comprises two pairs 25 and 25' of cooperating electrically conductive switch blades 26 and 27 respectively having adjacent terminal ends 28 and 29 secured in stacked relation to the support means 21 by a plurality of electrically non-conductive support plates 30, 31 and 32 as illustrated. In this manner, each pair 25 or 25' of switch blades 26 and 27 has the free ends 33 and 34 thereof disposed adjacent an electrically non-conductive separator means or cam means 35 of the armature means 24 which is adapted to slide on a surface 36 of a support plate 37 to be inserted between the switch blades 26 and 27 of each pair 25 and 25' in the manner illustrated in FIG. 3 to spread apart the switch blades 26 and 27 in opposition to the natural biasing force thereof and thereby hold the respective contact means 38 and 39 of the switch blades 36 and 37 in an open condition as illustrated in FIG. 3.

However, when the armature means 24 is moved from right to left in the manner illustrated in FIG. 5 by the energized coil means 22 in a manner hereinafter set forth, the separator or cam means 35 of the armature means 24 is pulled from between the switch blades 26 and 27 of the pairs 25 and 25' thereof so that the natural bias of the switch blades 26 and 27 will place the contact means 38 and 39 thereof into contact with each other to complete an electrical circuit therethrough for any desired switching function. Subsequently, when the coil means 22 is de-energized, the armature means 24, in a manner hereinafter described, moves from a position illustrated in FIG. 5, back to the position illustrated in FIG. 3 wherein the separator means 35 of the armature means 34 cams between the outwardly bent end portions 40 and 41 of the free ends 33 and 34 of the switch blades 26 and 27 to again move the contact means 38 and 39 thereof out of contact with each other in the manner illustrated in FIG. 3.

The coil means 22 comprises a conventional spool type member 42 secured to the support means 21 and having an opening 43 therethrough and in which a portion 44 of the armature means 24 reciprocates in a manner well known in the art for solenoids or relays, the spool member 42 having an electrical wire means 45 wound thereon and adapted to be energized by being interconnected to a D.C. electrical power source (not shown) so that the energized coil means 22 will pull the portion 44 of the armature means 24 into the opening 43 in a manner well known in the art until the armature 24 would bottom out therein, i.e. provide a zero gap position with the coil means 45 in a conventional manner if a unique spring means of this invention were not utilized to prevent the armature 24 from reaching the zero gap or non-moving position thereof with the energized coil means 22 as will be apparent hereinafter.

The cam means or separator means 35 of the armature means 24 is adapted to be interconnected to the portion 44 of the armature means 24 by a pivot pin arrangement 46 and includes an enlarged section 47 which has a slot means 48 passing completely through opposed sides 49 and 50 thereof.

The slot means 48 is defined in part by an angled surface 51 thereof and a transverse post means 52 is disposed in the slot means 48 and is spaced from the apex 53 of the angled surface 51 as illustrated in FIG. 2.

A pair of leaf spring members 54 and 55 are press-fitted into the slot means 48 between the post 52 and the angled surface 51 as illustrated in FIG. 2 so that the opposed ends 56 and 57 of the leaf spring members 54 and 55 extend outwardly from the opposed sides 49 and 50 of the armature means 24 while medial portions 58 thereof are disposed in stacked press-fit relation between the post means 52 and the angled surface 51 to thereby secure the leaf spring members 54 and 55 to the armature means 24.

The separator means 35 of the armature means 24 is formed of electrically insulating material and the post means 52 is likewise formed of electrically insulating material or covered by the same as illustrated.

The leaf spring member 54 is normally bowed in the configuration illustrated in FIG. 2 so that the opposed ends 56 and 57 thereof continuously bear against a pair of post abutment means 59 and 60 of the support means 21 so as to continuously tend to urge the armature means 24 further to the right in FIG. 2 in opposition to the natural bias of switch blades 26 and 27 to cam the armature means 24 to the left as well as in opposition to the natural bias of the leaf spring member 55.

In particular, when the armature means 24 is disposed in the position illustrated in FIG. 2, the opposed ends 56 and 57 of the leaf spring member 55 bear against a pair of abutments 61 and 62 of the support means 21 so that the natural bias of the leaf spring member 55 is to tend to resist further movement of the armature means 24 to the right in FIG. 2 under the natural biasing force of the leaf spring member 54.

Thus, it can be seen that the electrical switch construction 20 of this invention as illustrated in FIGS. 1–5 can be formed from a relatively few parts in a relatively simple manner by the method of this invention to operate in a manner now to be described.

Assuming the coil means 22 is in a de-energized condition thereof, the force of the leaf spring member 54 to return to its fully bowed condition has moved the armature means 24 to the right to the position illustrated in FIGS. 2 and 3 wherein the separator means 35 is completely disposed between the adjacent free ends 33 and 34 of the switch blades 26 and 27 of the pairs 25 and 25' thereof to hold the contact means 38 and 39 in an open condition relative to each other in the manner illustrated in FIG. 3. Thus, electrical circuits cannot be completed through each pair of switch blades 25 and 25' as long as the switch construction 20 remains in the condition illustrated in FIG. 3.

However, when the coil means 22 is energized by being interconnected to a source of D. C. current (not shown), the energized coil means 22 pulls the portion 44 of the armature means 24 further into the opening means 43 thereof in the manner conventional in the art for electrical relay or solenoid operation and such movement of the armature means 24 to the left causes the separator means 35 thereof to move to the position illustrated in FIGS. 4 and 5 where the same is completely removed from between the adjacent ends 33 and 34 of the switch blades 26 and 27 of the pairs 25 and 25' thereof so that the contact means 38 and 39 are placed into electrical contact with each other by the natural bias of the switch blades 26 and 27 to thereby complete electrical circuits through such closed contact means 38 and 39 for any desired purpose.

For example, such an electrical switch construction 20 can be utilized as controlling the top electrical heater element of an electrical cooking range or the like. However, it is to be understood that the electrical switch construction 20 of this invention can be utilized for any desired purpose.

As previously stated, it is a feature of this invention to utilize the spring means 54, 55 to prevent the portion 44 of the armature means 24 from reaching its zero gap or normal non-moving position within the energized coil means 22 as it has been found that if the armature means 24 reaches such zero gap position with the energized coil means 22, a resulting noise occurs which would make the switch construction 20 completely unacceptable for an electrical cooking range application thereof, because of the continuous cycling on and off thereof required for the normal operation of a range top heater element or the like. In fact, even the use of A.C. electrical current would be unsatisfactory for such switch use because of the noise encountered in A.C. current use is louder than the noise produced by D.C. current in electrical relays or solenoids.

Therefore, the leaf spring members 54 and 55 of this invention are uniquely designed so that the same increase their force resisting movement of the armature means 24 to its zero gap position to overcome the pulling in force of the energized coil means 22 before the armature means 24 reaches its zero gap position therewith.

In particular, during the initial movement of the armature means 24 to the left from the position illustrated in FIG. 2, such movement of the armature 24 is resisted by the leaf spring member 54 being continuously pulled into a reverse bowing configuration thereof against the post means 59 and 60 and subsequently the other leaf spring member 55 has its ends 56 and 57 brought into stacked relation against the ends 56 and 57 of the leaf spring member 54 to cause both leaf spring members 54 and 55 to begin to be counter bowed in the manner illustrated in FIG. 4 by the armature means 24 continuing to move to the left. However, such adding of the force of the leaf spring members 54 and 55 together and causing further reverse bowing thereof by the armature means 24 moving to the left in the drawings, causes the resisting force of the leaf spring members 54 and 55 to eventually overcome the increasing pulling in force of the coil means 22 to stop the movement of the armature means 24 to the left before the same reaches its zero gap position thereof and thereby renders the switch construction 20 relatively noiseless.

Figure 6:
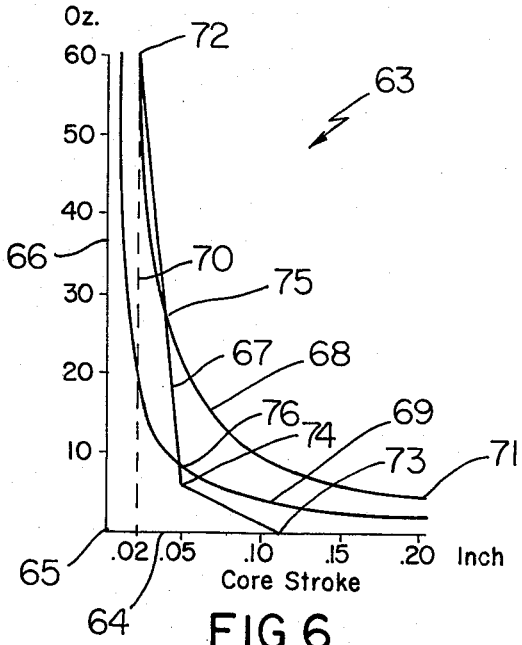
FIG. 6 is a graph illustrating the forces developed during the switching operation of the switch construction of FIG. 1.

For example, reference is made to FIG. 6 wherein a graph is generally indicated by the reference numeral 63 and illustrates on the X axis 64 thereof the distance of movement of the armature 24 and spring members 54, 55 with the point 65 on the X axis 64 representing the zero gap position of the armature 24 with the energized coil means 22. The Y axis 66 of the graph 63 represents the force being provided by the energized coil means 22 on the armature means 24 as well as the force being produced by the leaf spring members 54,55.

The line 67 on the graph 63 represents the action of the spring means 54 and 55 while the line 68 represents the action of the coil means 22 in its energized condition but while the same is initially in a cold condition thereof. The line 69 on the graph 63 represents the action of the energized solenoid coil means 22 when the same is in a hot condition thereof i.e., after the same has been in a cycling on and off condition and therefore is relatively warm compared to an initial energized cycle thereof.

The dashed vertical line 70 on the graph 63 represents an ideal position for stopping the movement of the armature 24 from its zero gap position 65 of FIG. 6 and is approximately 0.02 of an inch from the zero gap position 65.

It has been found that the electrical switch construction 20 of this invention operates in the manner illustrated in FIG. 6 so that as the cold coil means 22 is initially energized, the same has a pulling in force on the armature 24 that begins at the point 71 and progressively increases in force as the armature progressively moves toward the zero gap position 65 so that the force curve for the cold coil means 22 begins at the point 71 and runs to the point 72 on the graph 63.

However, it can be seen from the line 67 on the graph 63 that as the armature means 24 is being pulled toward its zero gap position 65 by the energized cold coil means 22, the force being produced by the spring means 54 begins increasing from the point 73 on the line 67 to the point 74 where the force of the additional spring member 55 is added therewith so that the combined forces of the spring means 54 and 55 resisting the pulling in action of the armature means 24 then increases from the point 74 to the point 72 on the line 67.

However, at the point 75 on the graph 63, it can be seen that the combined force of the spring means 54 and 55 increases beyond the pulling in force of the cold energized coil means 22 to thereby stop the movement of the armature means 24 somewhere between the points 0.02 and 0.05 on the X axis 64 so that the armature 24 does not reach its zero gap position 65.

When the coil means 22 is running in a hot condition thereof, as represented by the line 69 on the graph 63, it can be seen that when the force of the spring means 54 and 55 reaches the point 76 on the line 67 thereof, the force of the spring means 54 and 55 has increased beyond the pulling in force of the hot coil means 22 as represented by the line 69 so that the movement of the armature means 24 toward the zero gap position 65 thereof is also stopped somewhere between the points 0.02 and 0.05 on the X axis 64 of the graph 63.

Accordingly, it can be seen that the unique spring arrangement 54, 55 of this invention comprises a mechanical spring means that continuously acts on the armature means 24 as the same moves from the position illustrated in FIG. 3 to the position illustrated in FIG. 5 to overcome the increasing pulling in force of the energized coil means 22 on the armature means 24 before the armature means 24 reaches its zero gap position 65 whereby the spring means 54, 55 prevents the armature means 24 from reaching its zero gap position and thereby causes the switch construction 20 of this invention to be relatively noiseless in the operation thereof.

Thus, with the switch construction 20 now in the condition illustrated in FIG. 5, the armature means 24 remains in the position illustrated in FIG. 5 as long as the coil means 22 remains energized. However, once the coil means 22 becomes de-energized, the force of the spring means 54, 55 moves the armature means 24 from left to right and causes the separator means 35 to move in between the bent ends 40 and 41 of the switch blades 26 and 27 of the pairs 25 and 25' thereof and spread the switch blades 26 and 27 apart so that by the time that the armature means 24 reaches the position illustrated in FIG. 3, the contacts 38 and 39 are held in an open position relative to each other and the combined action of the spring blades 26 and 27 and the leaf spring member 55 engaging the abutments 61 and 62 prevents the leaf spring member 54 from further moving the armature means 24 to the right. Thus, the switch construction 20 now remains in the condition illustrated in FIG. 3 as long as the coil means 22 remains in a de-energized condition thereof.

Accordingly, it can be seen that the switch construction 20 of this invention operates in a unique manner to render the same substantially noiseless.

While one form of spring means has been provided for the switch construction 20, it is to be understood that other types of mechanical spring means can be utilized and provide the same feature of preventing the armature means from reaching its zero gap position and to render the switch construction relatively noiseless.

Figure 7:
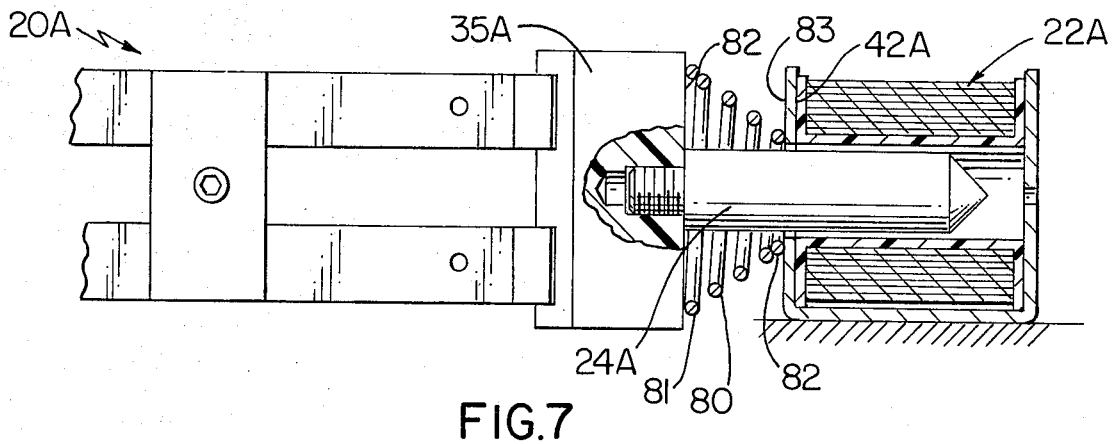
FIG. 7 is a view similar to FIG. 2 and illustrates another switch construction of this invention.

For example, reference is now made to FIG. 7 wherein another electrical switch construction of this invention is generally indicated by the reference numeral 20A and parts thereof similar to parts of the switch construction 20 are indicated by like reference numerals followed by the reference letter "A."

As illustrated in FIG. 7, a coiled compression spring 80 is disposed between the armature means 24A and the spool 42A of the coil means 22A with its enlarged end 81 bearing against a surface 82 of the separator means 35A of the armature means 24A and its smaller end 82 bearing against the side 83 of the spool 42A as illustrated.

By having the coiled compression spring 80 substantially frusto-conical in configuration, it can be seen that as the armature means 24A is being moved to the right in FIG. 7 by the energized coil means 22A, larger and larger coils of the spring 80 will abut against spool 42A and thereby cause the resisting force of the spring 80 to progressively increase as the armature means 24A is moving to the right in FIG. 7 so that eventually the force of the compression spring 80 resisting the movement of the armature means 24A to the right in FIG. 7 overcomes the pulling in force of the energized coil means 22A before the armature means 24A reaches its zero gap position with the coil means 22A.

Thus, it can be seen that the mechanical spring means 80 for the switch construction 20A operates in substantially the same manner as the spring means 54, 55 of the switch construction 20 previously described to render the switch construction 20A substantially noiseless in the operation thereof.

Figure 8:
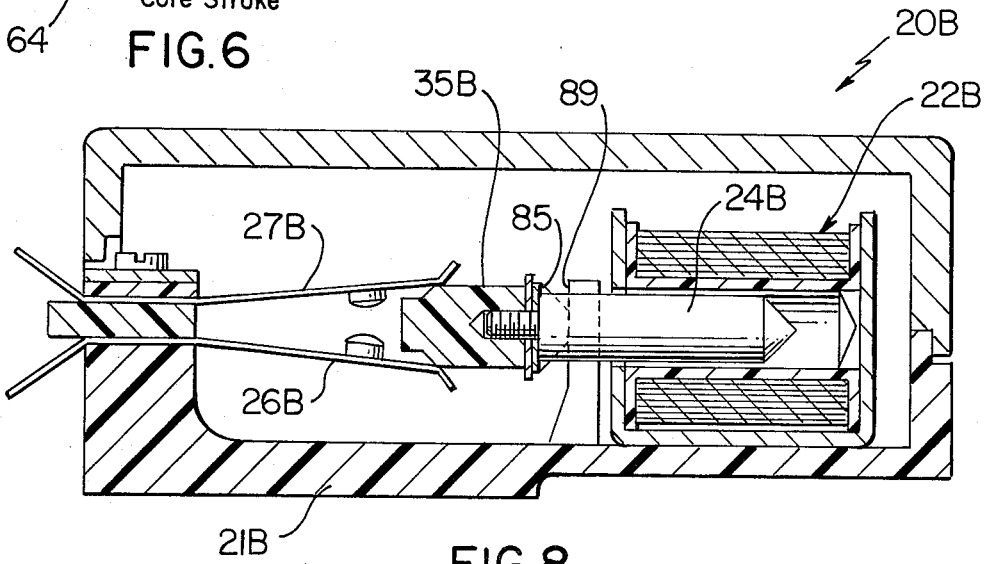
FIG. 8 is a cross-sectional view similar to FIG. 3 and illustrates another switch construction of this invention.
Figure 9:
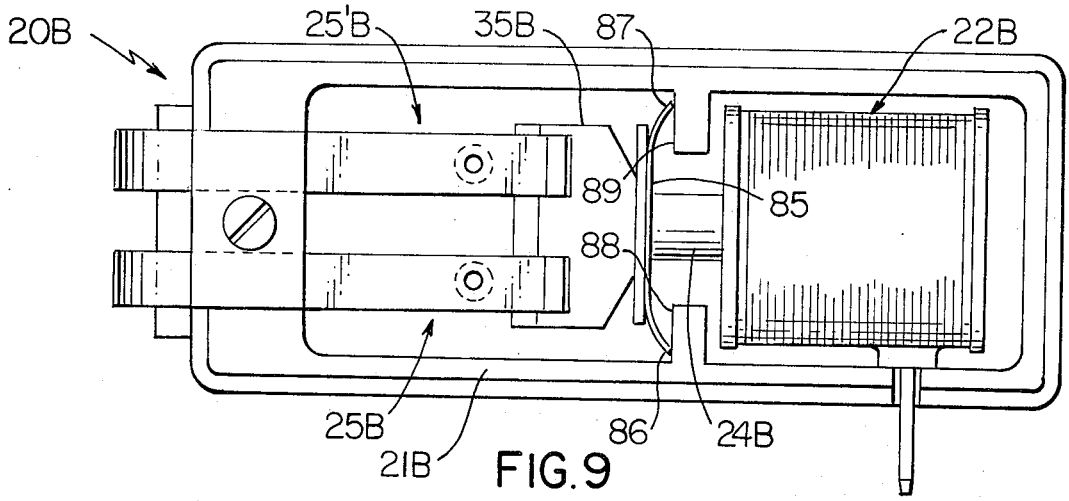
FIG. 9 is a top view of the switch construction of FIG. 8 with the cover removed.

Another switch construction of this invention is generally indicated by the reference numeral 20B in FIGS. 8 and 9 and parts thereof similar to parts of the switch construction 20 previously described are indicated by like reference numerals followed by the reference letter "B."

As illustrated in FIGS. 8 and 9, the switch construction 20B includes a leaf-like spring member 85 carried by the armature means 24B so as to have the opposed ends 86 and 87 thereof continuously bear against inwardly directed abutment surfaces 88 and 89 of the support means 21B.

In this manner, when the coil means 22B of the switch construction 20B is energized, the energized coil means 22B pulls the armature means 24B to the right in FIGS. 8 and 9 to tend to pull the separator means 35B thereof from between the switch blades 26B and 27B of the pairs 25B and 25'B thereof and such movement of the armature means 24B to the right is continuously resisted by the spring member 85 continuously being unbowed out of its natural configuration by the rightward movement of the armature means 24B until the force of the spring means 85 overcomes the pulling in force of the coil means 22B which occurs before the armature means 24B reaches its zero gap position for the reasons previously set forth. The increasing force of the spring member 85 is provided by its ends 86 and 87 spreading further apart as the armature means 24B moves further into the energized coil means 22B.

It was found according to the teachings of this invention, that the difference in the pulling in force of an energized coil means between the hot and cold extremes thereof as represented by the curves 68 and 69 on the graph 63 of FIG. 6 can be reduced if the heat developed in the solenoid coil means 22 can be readily dissipated.

Accordingly, it was found according to the teachings of this invention that the heat of the energized coil means can be readily dissipated if the support means comprises a steel base which will act as a heat sink. In this manner, the dissipated heat will reduce the pulling in power and simplify the spring arrangement of this invention tending to resist the movement of the armature means to the zero gap position thereof.

Figure 10:
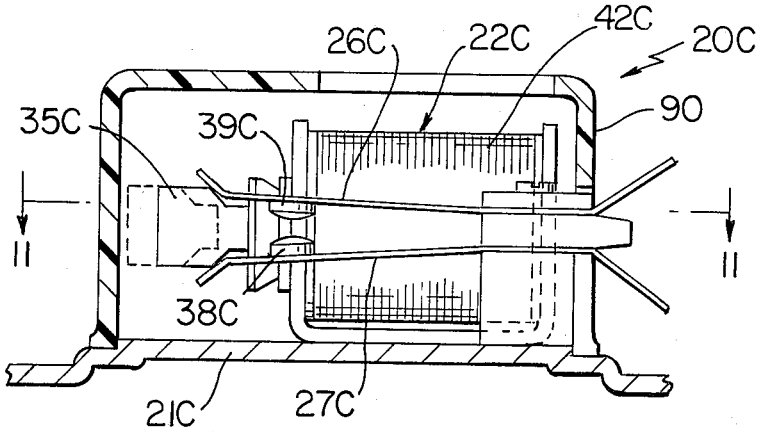
FIG. 10 is a view similar to FIG. 8 and illustrates another switch construction of this invention.
Figure 11:
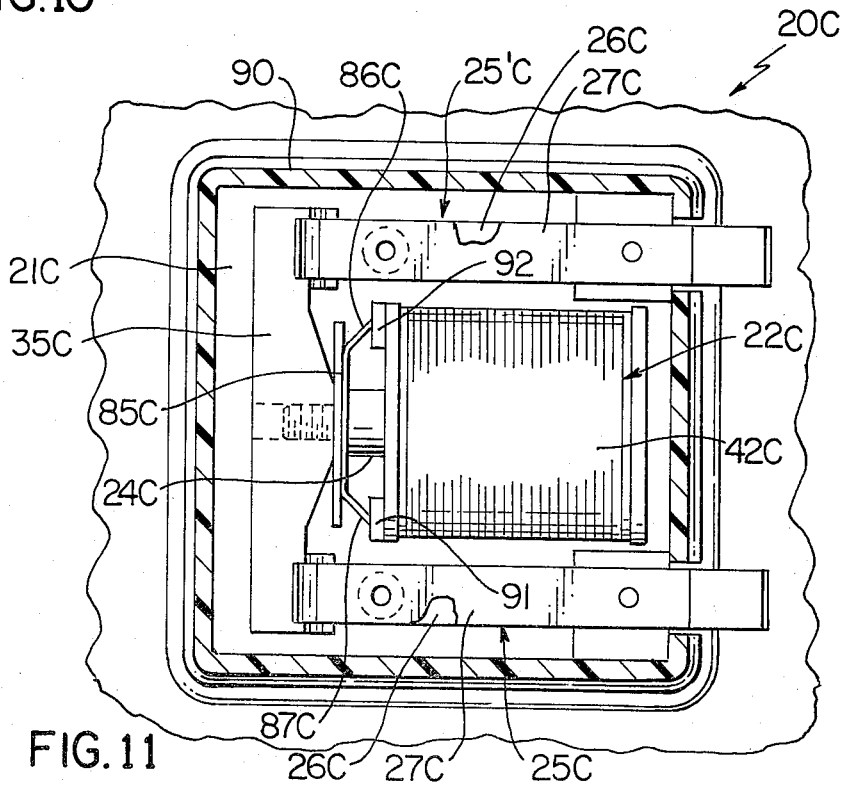
FIG. 11 is a cross-sectional view take on line 11—11 of FIG. 10.

For example, another switch construction of this invention is generally indicated by the reference numeral 20C in FIGS. 10 and 11 and parts thereof similar to the switch construction 20 previously described are indicated by like reference numerals followed by the reference letter "C."

As illustrated in FIGS. 10 and 11, the switch construction includes a steel base member 21C and a plastic cover member 90 so that the base 21C will act as the aforementioned heat sink for the coil means 22C.

While the switch constructions 20, 20A and 20B previously described have the contact means thereof closing upon the energizing of the respective coil means 22, 22A and 22B thereof, it is to be understood that the various features of this invention can be utilized to cause the contact means to open upon the energizing of the coil means.

For example, the switch construction 20C of FIGS. 10 and 11 has the contact means 38C and 39C of the switch blades 26C and 27C thereof opened by the separator means 35C of the armature means 24C when the armature means 24C is pulled into the energized coil means 22C from the normal dotted line position of FIG. 10 to the full line position of FIG. 10 as the pairs 25C and 25'C of switch blades 26C and 27C are disposed in side-by-side relation to the coil means 22C and armature means 24C as illustrated in FIGS. 10 and 11.

In contrast, the pairs 25 and 25' of switch blades in the other switch constructions 20, 20A and 20B are disposed in substantially a straight line relation with the respective armature means 24, 24A and 24B therefor rather than in the side-by-side relation as illustrated in FIGS. 10 and 11.

A spring means 85C is carried by the armature means 24C of the switch construction 20C to have the opposed ends 86C and 87C thereof engage against cooperating surface means 91 and 92 of the spool 42C of the coil means 22C to resist the movement of the armature means 24C into the energized coil means 22C to overcome the pulling in force thereof before the armature means 24C reaches its zero gap position to render the electrical switch construction 20C relatively noiseless for the reasons previously set forth, the ends 86C and 87C of the leaf spring member 85C spreading outwardly to increase its resisting force as the armature means 24C moves into the energized coil means 22C so as to overcome the pulling in force as previously discussed.

Therefore, it can be seen that in all of the electrical switch constructions of this invention, a mechanical spring means is utilized to overcome the pulling in force of the respective energized coil means on the armature means that causes a switching function of the switch contact means operatively associated with that armature means before that armature means reaches its zero gap position, whether or not the switch contact means are closing or opening upon the energizing of the coil means.

Further, it can be seen that such mechanical spring means is also being utilized as a means for returning the armature means to its normal position when the coil means is subsequently deenergized.

Accordingly, it can be seen that this invention not only provides an improved electrical switch construction of the coil-armature actuator type, but also this invention provides an improved method of making such a switch construction or the like.

While the forms and methods of this invention now preferred have been illustrated and described as required by the Patent Statute, it is to be understood that other forms and method steps can be utilized and still fall within the scope of the appended claims.

What is claimed is:

1. In a switch construction having support means carrying switch contact means and an electrical coil means that has an armature means operatively associated with said switch contact means to cause a switching operation therewith when said coil means is energized to attract said armature means from a first position thereof to a second position thereof relative to said coil means, the improvement comprising mechanical spring means operatively associated with said armature means to continuously resist said movement thereof from said first position to said second position with an increasing force that overcomes the increasing pull in force of said energized coil means on said armature means before said armature means reaches its zero gap with said energized coil means whereby said spring means prevents said armature means from reaching its said zero gap and thereby causes said switch construction to be relatively noiseless in the operation thereof.

2. A switch construction as set forth in claim 1 wherein said armature means has a portion thereof that moves inside said coil means when said armature means moves between said first position thereof and said second position thereof.

3. A switch construction as set forth in claim 1 wherein said mechanical spring means moves said armature means to said first position thereof when said coil means is in a deenergized condition thereof.

4. A switch construction as set forth in claim 1 wherein said spring means comprises a coiled spring.

5. A switch construction as set forth in claim 1 wherein said spring means comprises a leaf spring member.

6. A switch construction as set forth in claim 1 wherein said spring means comprises a plurality of leaf spring members.

7. A switch construction as set forth in claim 6 wherein said leaf spring members serially add their forces together as said armature means is moved from said first position thereof to said second position thereof.

8. A switch construction as set forth in claim 1 wherein said switch contact means includes at least one pair of cooperating switch contacts respectively carried by a pair of switch blades and normally biased toward each other to place said contacts into contact with each other.

9. A switch construction as set forth in claim 8 wherein said armature means moves said contacts away from each other as said armature means moves from said first position thereof to said second position thereof.

10. A switch construction as set forth in claim 8 wherein said armature means moves said contacts toward each other as said armature means moves from said first position to said second position thereof.

11. A switch construction as set forth in claim 8 wherein said switch blades are disposed substantially parallel to each other and substantially parallel to the movement of said armature means.

12. A switch construction as set forth in claim 11 wherein said armature means has a separator means for moving between said blades.

13. A switch construction as set forth in claim 12 wherein said separator means has cam means for acting against said blades to cam said blades apart as said separator means moves between said blades.

14. A switch construction as set forth in claim 11 wherein said switch blades and said armature means are disposed in side-by-side relation.

15. A switch construction as set forth in claim 11 wherein said switch blades and said armature means are disposed in substantially straight line relation.

16. A switch construction as set forth in claim 1 wherein said armature means carries said spring means.

17. A switch construction as set forth in claim 16 wherein said spring means includes a leaf spring member having a pair of opposed ends and a medial portion, said medial portion of said leaf spring member being interconnected to said armature means and said opposed ends of said leaf spring member extending outwardly from opposed sides of said armature means.

18. A switch construction as set forth in claim 17 wherein said opposed ends of said leaf spring member bear against said coil means.

19. A switch construction as set forth in claim 17 wherein said opposed ends of said leaf spring member bear against said support means.

20. A switch construction as set forth in claim 19 wherein said support means has a pair of posts against which said opposed ends of said leaf spring member respectively bear.

21. A switch construction as set forth in claim 17 wherein said spring means includes a second leaf spring member having a pair of opposed ends and a medial portion, said medial portion of said second leaf spring member being interconnected to said armature means and said opposed ends of said second leaf spring member extending outwardly from said opposed sides of said armature means.

22. A switch construction as set forth in claim 21 wherein said opposed ends of the first mentioned leaf spring member bear against said support means when said armature means is disposed in said first position thereof to tend to resist movement of said armature means toward said second position thereof, said opposed ends of said second leaf spring member being adapted to bear against said support means to tend to resist said movement of said armature means toward said second position thereof after said armature means has moved from said first position thereof and before said armature means has moved to said second position thereof.

23. A switch construction as set forth in claim 22 wherein said opposed ends of said second leaf spring member are adapted to bear against said support means to tend to resist movement of said armature means from moving to said first position thereof after armature means has moved from said second position thereof and before said armature means has moved to said first position thereof.

24. A switch construction as set forth in claim 23 wherein said first mentioned leaf spring member provides the force for moving said armature means from said second position thereof to said first position thereof when said coil means is deenergized.

25. A switch construction as set forth in claim 21 wherein said armature means has slot means passing transversely therethrough, said medial portions of said leaf spring members being press-fitted in stacked relation in said slot means to interconnect the same to said armature means.

26. In a method of making a switch construction having support means carrying switch contact means and an electrical coil means that has an armature means operatively associated with said switch contact means to cause a switching operation therewith when said coil means is energized to attract said armature means from a first position thereof to a second position thereof relative to said coil means, the improvement comprising the step of arranging a mechanical spring means to be operatively associated with said armature means to continuously resist said movement thereof from said first position to said second position with an increasing force that overcomes the increasing pull in force of said energized coil means on said armature means before said armature means reaches its zero gap with said energized coil means whereby said spring means prevents said armature means from reaching its said zero gap and thereby causes said switch construction to be relatively noiseless in the operation thereof.

27. A method of making a switch construction as set forth in claim 26 and including the step of forming said armature means with a portion thereof to move inside said coil means when said armature means moves between said first position thereof and said second position thereof.

28. A method of making a switch construction as set forth in claim 26 and including the step of forming said mechanical spring means to move said armature means to said first position thereof when said coil means is in a deenergized condition thereof.

29. A method of making a switch construction as set forth in claim 26 and including the step of forming said spring means from a coiled spring.

30. A method of making a switch construction as set forth in claim 26 and including the step of forming said spring means from a leaf spring member.

31. A method of making a switch construction as set forth in claim 26 and including the step of forming said spring means from a plurality of leaf spring members.

32. A method of making a switch construction as set forth in claim 31 and including the step of arranging said leaf spring members to serially add their forces together as said armature means is moved from said first position thereof to said second position thereof.

33. A method of making a switch construction as set forth in claim 26 and including the step of forming said switch contact means to include at least one pair of cooperating switch contacts respectively carried by a pair of switch blades and normally biased toward each other to place said contacts into contact with each other.

34. A method of making a switch construction as set forth in claim 33 and including the step of forming said armature means to move said contacts away from each other as said armature means moves from said first position thereof to said second position thereof.

35. A method of making a switch construction as set forth in claim 33 and including the step of forming said armature means to move said contacts toward each other as said armature means moves from said first position to said second position thereof.

36. A method of making a switch construction as set forth in claim 33 and including the step of disposing said switch blades so as to be substantially parallel to each other and substantially parallel to the movement of said armature means.

37. A method of making a switch construction as set forth in claim 36 and including the step of forming said armature means to have a separator means for moving between said blades.

38. A method of making a switch construction as set forth in claim 37 and including the step of forming said separator means with a cam means for acting against said blades to cam said blades apart as said separator means moves between said blades.

39. A method of making a switch construction as set forth in claim 36 and including the step of disposing said switch blades and said armature means in side-by-side relation.

40. A method of making a switch construction as set forth in claim 36 and including the step of disposing said switch blades and said armature means so as to be in substantially straight line relation.

41. A method of making a switch construction as set forth in claim 26 and including the step of forming said armature means to carry said spring means.

42. A method of making a switch construction as set forth in claim 41 and including the steps of forming said spring means to include a leaf spring member having a pair of opposed ends and a medial portion, and interconnecting said medial portion of said leaf spring member to said armature means so that said opposed ends of said leaf spring member extend outwardly from opposed sides of said armature means.

43. A method of making a switch construction as set forth in claim 42 and including the step of forming said opposed ends of said leaf spring member to bear against said coil means.

44. A method of making a switch construction as set forth in claim 42 and including the step of forming said opposed ends of said leaf spring member to bear against said support means.

45. A method of making a switch construction as set forth in claim 44 and including the step of forming said support means with a pair of posts against which said opposed ends of said leaf spring member respectively bear.

46. A method of making a switch construction as set forth in claim 42 and including the steps of forming said spring means to include a second leaf spring member having a pair of opposed ends and a medial portion, and interconnecting said medial portion of said second leaf spring member to said armature means so that said opposed ends of said second leaf spring member extend outwardly from said opposed sides of said armature means.

47. A method of making a switch construction as set forth in claim 46 and including the steps of disposing said opposed ends of the first mentioned leaf spring member to bear against said support means when said armature means is disposed in said first position thereof to tend to resist movement of said armature means toward said second position thereof, and disposing said opposed ends of said second leaf spring member to be adapted to bear against said support means to tend to resist said movement of said armature means toward said second position thereof after said armature means has moved from said first position thereof and before said armature means has moved to said second position thereof.

48. A method of making a switch construction as set forth in claim 47 and including the step of disposing said opposed ends of said second leaf spring member to be adapted to bear against said support means to tend to resist movement of said armature means from moving to said first position thereof after armature means has moved from said second position thereof and before said armature means has moved to said first position thereof.

49. A method of making a switch construction as set forth in claim 48 and including the step of disposing said first mentioned leaf spring member to provide the force for moving said armature means from said second position thereof to said first position thereof when said coil means is deenergized.

50. A method of making a switch construction as set forth in claim 46 and including the steps of forming said armature means with slot means passing transversely therethrough, and press-fitting said medial portions of said leaf spring members in stacked relation in said slot means to interconnect the same to said armature means.

* * * * *